US006875121B2

(12) United States Patent
McKeen, Jr.

(10) Patent No.: US 6,875,121 B2
(45) Date of Patent: Apr. 5, 2005

(54) METHOD OF PLAYING AN OUTDOOR BULLS-EYE TARGET GOLF GAME

(76) Inventor: Hugh B. McKeen, Jr., H C 61 Box 175, Glenwood, NM (US) 88039

( * ) Notice: Subject to any disclaimer, the term of this patent is extended or adjusted under 35 U.S.C. 154(b) by 0 days.

(21) Appl. No.: 10/438,124

(22) Filed: May 15, 2003

(65) Prior Publication Data

US 2004/0229706 A1 Nov. 18, 2004

(51) Int. Cl.[7] ..... A63B 69/36
(52) U.S. Cl. ..... 473/168; 473/409
(58) Field of Search ..... 473/168–170, 473/172, 195, 196

(56) References Cited

U.S. PATENT DOCUMENTS 1,527,988 A * 3/1925 McMurtrie ..... 273/400
2,164,808 A 7/1939 Everett
3,490,769 A * 1/1970 Torbett ..... 473/196
3,599,980 A * 8/1971 Harmond et al. ..... 473/153
3,649,027 A 3/1972 Vallas
3,695,619 A * 10/1972 Brobston ..... 473/169
3,708,173 A * 1/1973 Hewson, Jr. ..... 473/153
3,722,889 A * 3/1973 Miller ..... 473/169
3,917,279 A * 11/1975 Barber ..... 473/153
4,145,053 A * 3/1979 Healey ..... 473/169
4,171,134 A * 10/1979 Reck ..... 473/196
4,928,973 A 5/1990 Perry et al.
4,934,704 A 6/1990 Mazer
4,988,105 A 1/1991 Perry et al.
5,383,665 A * 1/1995 Schultz et al. ..... 473/159
5,401,027 A 3/1995 Surbeck
5,439,224 A * 8/1995 Bertoncino ..... 473/153
5,490,671 A 2/1996 Picard
5,513,841 A * 5/1996 Takagi ..... 473/134
5,636,844 A * 6/1997 de Buys ..... 273/317.2
5,655,972 A * 8/1997 Heitzman ..... 473/172

* cited by examiner

*Primary Examiner*—Mark S. Graham

(57) ABSTRACT

An outdoor bulls-eye target golf course comprises a natural surface, a single target area along the natural surface and a plurality of tee stations along the natural surface at various predetermined distances from a target hole of the target area. The target area includes a 0bulls-eye target with the target hole at its center and defined by a plurality of concentric target lines on a grassy area. A bulls-eye target golf game involves each player hitting a plurality of golf balls to the target hole from each tee station, eliminating the worst played ball hit from each tee station, and scoring the remaining balls hit from each tee station by assigning points to the balls depending on whether they land in the target hole, an inner target zone, an intermediate target zone, an outer target zone or outside of the target area.

20 Claims, 3 Drawing Sheets

50

| TEE STATION | DISTANCE | POINTS | | |
|---|---|---|---|---|
| | | BALL 1 | BALL 2 | BALL 1 + BALL 2 |
| 1 | 25 yds. | | | |
| 2 | 25 yds. | | | |
| 3 | 60 yds. | | | |
| 4 | 60 yds. | | | |
| 5 | 100 yds. | | | |
| 6 | 120 yds. | | | |
| 7 | 130 yds. | | | |
| 8 | 140 yds. | | | |
| 9 | 120 yds. | | | |
| 10 | 110 yds. | | | |
| 11 | 160 yds. | | | |
| 12 | 180 yds. | | | |
| | | | TOTAL POINTS | |

FIG. 4

METHOD OF PLAYING AN OUTDOOR BULLS-EYE TARGET GOLF GAME

BACKGROUND OF THE INVENTION

1. Field of the Invention

The present invention relates generally to outdoor bulls-eye target golf games and, more particularly, to outdoor bulls-eye target golf games incorporating skills applicable to traditional golf and especially incorporating chipping and pitching.

2. Discussion of the Related Art

The traditional game of golf as played on conventional nine or eighteen hole outdoor grass golf courses already has large numbers of enthusiastic participants of various ages and abilities while continuing to attract new participants at a rapid pace. The popularity of traditional golf has given rise to many various supporting activities and facilities, such as golf schools, driving ranges, putting greens, indoor golf courses and the like, by which players can practice and improve the skills utilized in traditional golf. Conventional golf courses, driving ranges and putting greens, however, are limited by their inability to adequately provide entertaining, enjoyable, motivational and informational practice scenarios for relatively shorter lofting shots such as chip and pitch shots. Traditional golf courses oftentimes provide practice tees for long shots and practice putting greens for putting, making it necessary for players to practice chipping and pitching on the regular greens. Practicing chipping and pitching by hitting to the regular greens has various drawbacks including interfering with regular play on the golf course, failing to provide quantifiable feedback to the player, and lack of competitive motivation and enjoyment. Although driving ranges are beneficial for practicing the full swing, they are ordinarily not used by players for the practice of chipping and pitching. Practice putting greens are typically limited in function and are not adequately designed for the practice of chip and pitch shots. Indoor facilities and some outdoor facilities have the additional disadvantage of employing artificial ground surfaces such that conditions do not replicate those encountered on a traditional golf course. Accordingly, one of the major obstacles to mastering chip and pitch shots in golf resides in the dearth of appealing and effective practice opportunities for chipping and pitching.

Target golf courses and/or target golf games have been proposed as an alternative or as an adjunct to traditional golf as represented by U.S. Pat. No. 2,164,808 to Everett, U.S. Pat. No. 3,649,027 to Vallas, U.S. Pat. No. 4,928,973 and U.S. Pat. No. 4,988,105 to Perry et al, U.S. Pat. No. 4,934,704 to Mazer, U.S. Pat. No. 5,401,027 to Surbeck, and U.S. Pat. No. 5,490,671 to Picard.

The Everett and Surbeck patents relate to outdoor bulls-eye target golf games in which a target area is delineated into a plurality of target zones by a plurality of concentric ring members installed on a grassy piece of ground to form a physical or structural border for each target zone. The target area is hit to from a single tee area, and points are assigned to each target zone for purposes of keeping score. The ring members, even when flush with the grass, impede the natural bounce and roll of a golf ball coming into contact therewith such that the golf games disclosed by the Everett and Surbeck patents are played under conditions non-analogous to those of traditional golf. By impeding the natural bounce and roll of a golf ball, the ring members affect the final resting place for the ball so that the outcome of the shot provides little useful feedback applicable to traditional golf regarding the player's skill and improvement. In the case of pitching and chipping practice, wherein an objective of skill refinement involves controlling the amount of roll, the physical obstructions presented by the ring members defeat the practice objectives. Another drawback to the ring members is that they must be removed and replaced each time the grass is manicured, thusly detracting from ease of use. The Everett and Surbeck games ascribe a higher point total to a good score, thusly requiring the players to adopt a mind-set contrary to traditional golf. The Surbeck game is small in size and uses plastic balls and clubs providing little real benefit to the traditional golf game, much less chipping and pitching. The Everett game requires the presence of a caddy or attendant at the target area to knock balls that have landed in the target zone into holes corresponding to the target zones. The holes communicate with corresponding return conduits which carry the balls back to the tee area. The need for an attendant restricts spontaneous play, and the return conduits essentially fix the location of the tee area relative to the target area given the difficulties involved in re-routing the return conduits. The need for return conduits also undesirably adds to the structural and functional complexity and cost of the game. Each target zone of the Everett patent has two holes, and the presence of so many holes is distracting and confusing as the central target hole may be indistinguishable from the other holes when viewed from a distance. Consequently, a player may be uncertain as to which hole to aim for, further detracting from the practice benefits capable of being derived from the game. The Everett and Surbeck golf games do not provide any opportunities for walking such that players do not derive any physical conditioning benefits applicable to traditional golf.

The Vallas, Perry et al, Mazer, and Picard patents disclose target golf courses which are generally complicated in design and execution. The golf courses disclosed by Vallas and Perry et al require many target areas to which shots are hit from a single confined tee area. The need for many target areas adds significantly to the cost and complexity of the golf courses, and the need for many target areas is also a drawback of the golf courses disclosed in the Mazer and Picard patents. The golf courses disclosed by Vallas, Perry et al, Mazer and Picard include hazards or obstacles presenting a high probability for loss of golf balls, thereby deterring use of the golf courses for routine practice. The Mazer golf course is designed as an indoor installation and has the disadvantage of artificial surfaces and conditions not analogous to those of traditional golf. Games played on the Mazer and Picard golf courses are won by the player with the highest point total, thusly necessitating a mental adjustment from the scoring concepts of traditional golf.

Conventional target golf courses and/or games are generally not designed for players of varying skill and ability while still being motivational for all players. Conventional target golf courses and/or games are ordinarily limited in the number of players that may play at one time, thusly excluding group play for groups having relatively many players. It is also apparent that conventional target golf courses and/or games do not provide practice situations, especially for pitching and chipping, which allow performance to be quantified and improved upon under conditions similar to those associated with traditional golf so that skills acquired and reinforced in practice may be directly applied to traditional golf. Target golf courses and/or games as conventionally known do not allow participants to effectively identify weaknesses and/or degree of improvement. Conventional target golf courses and/or games are generally not adaptable for being laid out on an irregular piece of ground using the existing topography with minimal or no modifications. In addition, conventional target golf courses and/or games typically lack a readily understandable system of rules and scoring compatible with the concepts of traditional golf.

In light of the foregoing, there is a need for an outdoor bulls-eye target golf game which incorporates chipping and pitching shots taken under conditions analogous to those encountered in traditional golf while providing enjoyment, entertainment, quantifiable feedback and competitive motivation for players of varying skill and ability. The need exists for an outdoor bulls-eye target golf game available for play without the need for time-consuming setup or preparation and without the need for attendants or caddies. There is a further need for an outdoor bulls-eye target golf game capable of being played by relatively large groups of players and according to an uncomplicated, easily comprehensible system of rules and scoring compatible with the concepts of traditional golf. Another need exists for an outdoor bulls-eye target golf game that conserves balls while still providing various diverse practice scenarios that challenge various diverse skills used in traditional golf. Yet an additional need exists for an outdoor bulls-eye target golf game which may be installed as an essentially permanent facility having the attributes of simplicity and economy.

SUMMARY OF THE INVENTION

Accordingly, it is an object of the present invention to overcome the aforementioned disadvantages of prior target golf courses and games.

Another object of the present invention is to enhance the practice opportunities available to golfers analogous to traditional golf.

An additional object of the present invention is to improve the practice opportunities available to golfers for chipping and pitching.

A further object of the present invention is to provide quantifiable feedback to a golfer for skills executed during practice.

It is also an object of the present invention to allow a golfer to gauge actual performance and improvement during practice.

Moreover, it is an object of the present invention to incorporate a variety of practice scenarios in an outdoor bulls-eye target golf course and game to competitively motivate the practice of various skills by players of various levels of skill and ability.

The present invention has as another object to provide an outdoor bulls-eye target golf course and game having the characteristics of structural and operational simplicity, versatility and economy while being compatible with the conditions and concepts of traditional golf.

Additionally, it is an object of the present invention to utilize repetition to foster skill development and improvement in shots taken at predetermined distances from a target hole in an outdoor bulls-eye target golf game.

Yet a further object of the present invention is to provide an outdoor bulls-eye target golf course and game combining skill execution and the opportunity for physical conditioning applicable to traditional golf.

The foregoing objects are achieved individually and in combination, and it is not intended that the present invention be construed as requiring two or more of the objects to be combined unless expressly required by the claims attached hereto.

Some of the advantages of the present invention are that the outdoor bulls-eye target golf course and game enable the accuracy of each shot to be determined; the outdoor bulls-eye target golf course and game allow weaknesses warranting further practice to be identified; the outdoor bulls-eye target golf course and game present a challenge for players ranging in skill and ability from beginners to experts and allow beginners and experts to play together under comparable conditions; beginners and other players can acquire and/or improve on basic golf skills for utilization in the traditional golf game; the repositioning of holes and/or flags is not required; the outdoor bulls-eye target golf course and game can be laid out within peripheral borders of various shapes and sizes; natural features and/or topography can be incorporated in the outdoor bulls-eye target golf course and game to provide obstacles and/or conditions for practicing particular skills; natural features and/or topography can be employed in the outdoor bulls-eye target golf course and game to provide various levels of difficulty; ordinary lawn grass may be used predominately as the playing surface such that bounce, roll and other ball actions replicate traditional golf; the outdoor bulls-eye target golf game is played with regular golf balls and clubs applicable to traditional golf; balls are marked or colored to remain conspicuous; the loss of balls is deterred; no structural members are needed to delineate the target lines; a variety of obstacles or hazards may be incorporated in the outdoor bulls-eye target golf course and game; predetermined distances established between the tee stations and the target hole enhance the value of informational feedback to the players; the target area comprises a single target hole identifying the target that players are to hit to; the use of a single target hole ensures that the target is clearly distinguishable to players; each player may complete his/her own score card similar to traditional golf; scoring is conceptually similar to traditional golf in that low scores are more favorable than high scores; motivation and encouragement are maintained for less skilled players; more than one golfer can hit to the target hole from a tee station at the same time thereby increasing the pace and reducing the time required to complete a game; a group of as many as twelve players can play the outdoor bulls-eye target golf course and game at one time; the outdoor bulls-eye target golf course and game may be laid out on a relatively small parcel of land, such as three to four acres; the outdoor bulls-eye target golf course and game is well-suited for installation in parks, recreation areas and as an adjunct to traditional golf courses; beginner players in particular may acquire basic golf skills from the outdoor bulls-eye target golf course and game prior to playing on a traditional golf course for the first time; and, by increasing the confidence and skill in beginner and other players for traditional golf, the outdoor bulls-eye target golf course and game make it more likely such players will develop a long-term commitment to participation in traditional golf.

These and other objects, advantages and benefits are realized with the present invention as generally characterized in an outdoor bulls-eye target golf course comprising a natural surface of appropriate size surface area, a target area along the natural surface and a plurality of tee stations at various predetermined distances from a target hole of the target area. The target area comprises a bulls-eye target defined by a plurality of concentric target lines, preferably deposited as a durable colored substance on the natural surface without any separate physical structure which would alter or impede the motion of golf balls contacting the target lines. The natural surface is lawn grass along the target area. In one embodiment, the target area comprises a first circular target line circumscribing an inner target zone, a second circular target line, larger in diameter than the first target line, circumscribing an intermediate target zone between the second target line and the first target line, and a third circular target line, larger in diameter than the second target line, circumscribing an outer target zone between the third target line and the second target line. The target hole is located at the center of the inner target zone for holding a standard golf ball. An elongate pole has its lower end permanently secured at the center of the target hole and its upper end carrying a flag above the natural surface for visualization by players at the tee stations. Each tee station has at least one, and preferably three, tee sites from which golf balls may be hit to the target hole. The tee sites for each tee station are located a predetermined distance from the target hole ranging from about 25 yards to about 180 yards. Some of the tee stations comprise grass along the natural surface, some comprise sand along the natural surface and some comprise dirt along the natural surface. In one embodiment, the golf course comprises first, second, third, fourth, fifth, sixth, seventh, eighth, ninth, tenth, eleventh and twelfth tee stations having tee sites located 25 yards, 25 yards, 60 yards, 60 yards, 100 yards, 120 yards, 120 yards, 130 yards, 140 yards, 110 yards, 160 yards and 180 yards, respectively, from the target hole with the first, third, fifth, ninth, tenth, eleventh and twelfth tee stations comprising close-cut grass along the natural surface, the sixth tee station comprising tall grass along the natural surface, the second, fourth and eighth tee stations comprising sand along the natural surface, and the seventh tee station comprising dirt along the natural surface. The golf course includes one or more obstacles or hazards between one or more of the tee stations and the target hole. Preferably, the one or more obstacles are non-aquatic natural features or formations that do not present a high risk of golf ball loss. In one embodiment, an obstacle comprising a plurality of trees is provided between the target hole and each of the third and tenth tee stations, the obstacle for the third tee station requiring players to hit over the obstacle from the third tee station and the obstacle for the tenth tee station requiring players to hit under the obstacle from the tenth tee station. Each tee station is preferably large enough in size to accommodate a plurality of players hitting from the tee sites of the tee station at the same time. An outdoor bulls-eye target golf game is played on the golf course using a plurality of standard golf balls for each player having conspicuous markings to distinguish the golf balls of a player from the golf balls of other players and a scorecard for each player for scoring balls hit from the tee stations to the target hole.

A method of playing an outdoor bulls-eye target golf game according to the present invention is generally characterized in the steps of each player hitting a plurality of standard golf balls for that player from a tee station to a target hole located a predetermined distance from the tee station in a grassy target area, and each player may select an appropriate conventional golf club for hitting the golf balls in accordance with the predetermined distance. Each player hits each golf ball to the target hole with one swing, and preferably each player hits three golf balls from the tee station to the target hole. Each player eliminates one of his/her plurality of golf balls that has landed furthest away from the target hole and scores the remaining plurality of his/her golf balls which have landed closer to the target hole than the eliminated ball. Scoring involves assigning one point for golf balls that have landed in the target hole, two points for golf balls that have landed in an inner target zone of the target area, three points for golf balls that have landed in an intermediate target zone of the target area, four points for golf balls that have landed in an outer target zone of the target area and five points for golf balls that have landed outside the target area. The steps of hitting, eliminating and scoring are repeated by each player for a plurality of the tee stations. After each tee station has been played, each player totals his/her points and the player with the lowest point total is declared the winner of the golf game. The step of hitting may involve more than one player hitting from the same tee station to the target hole at the same time. Hitting may involve hitting the golf balls over and/or under one or more obstacles or hazards located between the target hole and one or more of the tee stations. Scoring may be accomplished by each player recording his/her points on a score card for that player.

The above and other objects, features and advantages of the present invention will become more apparent from the following description of a preferred embodiment taken in conjunction with the accompanying drawings wherein like reference numerals refer to like or similar parts.

BRIEF DESCRIPTION OF THE DRAWINGS

FIG. 4 is a sample score card for use by a player in the outdoor bulls-eye target golf game.

DESCRIPTION OF THE PREFERRED EMBODIMENTS

Figure 1:
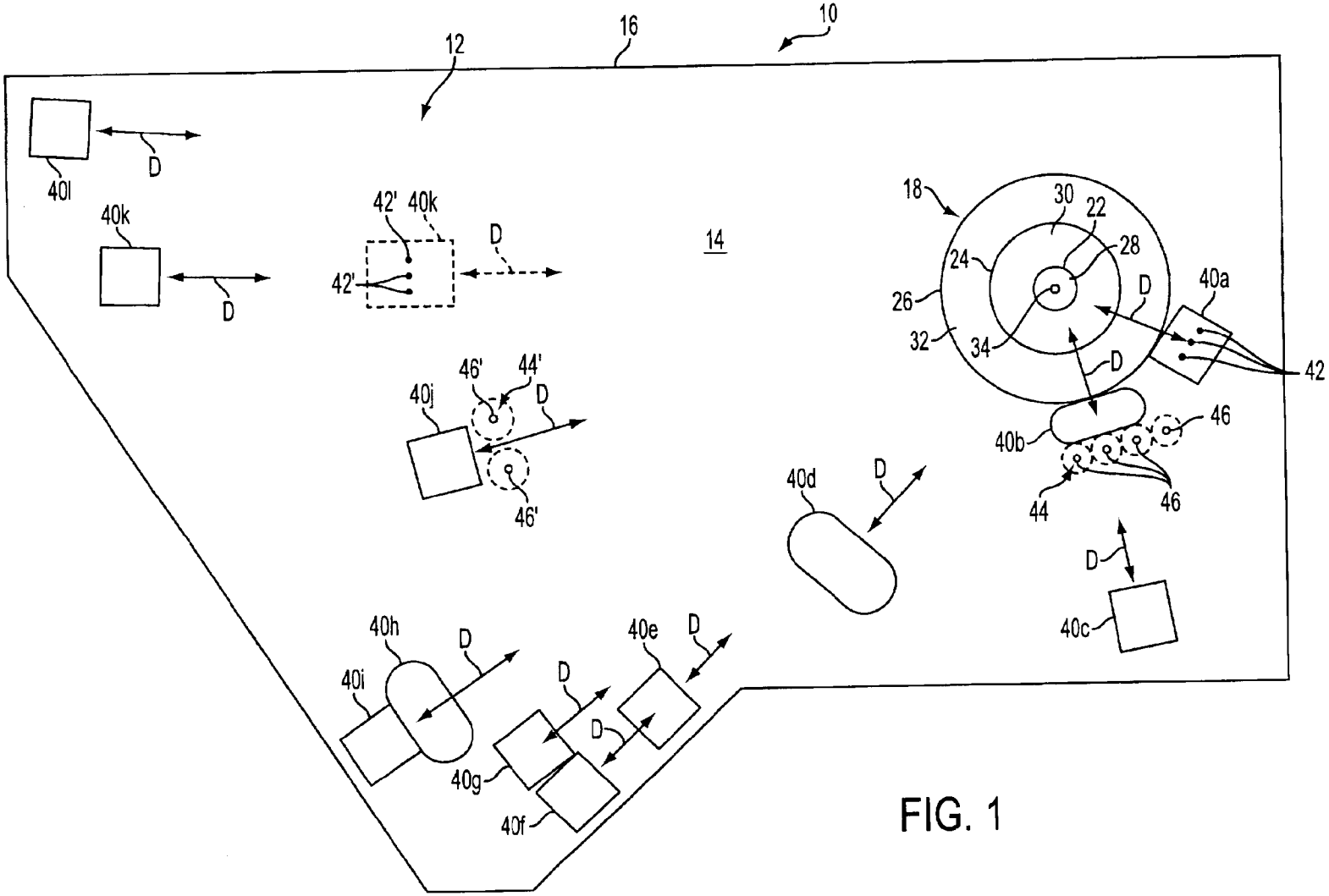
FIG. 1 is a top plan view of an outdoor bulls-eye target golf course according to the present invention.

An outdoor bulls-eye target golf course 10 according to the present invention is depicted in FIG. 1 for playing an outdoor bulls-eye target golf game. The outdoor bulls-eye target golf course 10 is laid out on a parcel of land 12 having a natural surface 14. The natural surface 14 has a surface area of appropriate size circumscribed by a periphery 16, which may be structural or imaginary. The periphery 16 may define various regular or irregular geometric shapes and may be formed by straight line segments, curved line segments or a combination of straight and curved line segments at various angles to one another. The parcel of land 12 will typically be about three to four acres in size but may be larger or smaller.

A target area 18 is located within the periphery 16 and comprises a grassy surface along natural surface 14 and a plurality of target lines 20 on the grassy surface. Preferably, the surface 14 comprises grass along substantially the entirety of its surface area but at least the target area 18 and the area surrounding target area 18 should be grass. Target lines 20 are concentrically arranged and include a first circular target line 22 having a first diameter, a second circular target line 24 having a second diameter, greater than the first diameter, and a third circular target line 26 having a third diameter, greater than the second diameter. As used herein, the terms "concentric" and "circular" are not intended to be construed as requiring perfect concentricity and circularity given that some margin of error is possible without detracting from the benefits of the invention. It is preferred that the target lines 20 are non-structural and are marked by depositing a durable colored substance on the grassy surface, with periodic re-marking of the target lines as needed. Paint or chalk may be used, for example, as the colored substance. The target lines 20 may be of appropriate width so as to be clearly visible. In one embodiment, the first diameter is 20 feet, the second diameter is 70 feet and the third diameter is 120 feet.

Figure 2:
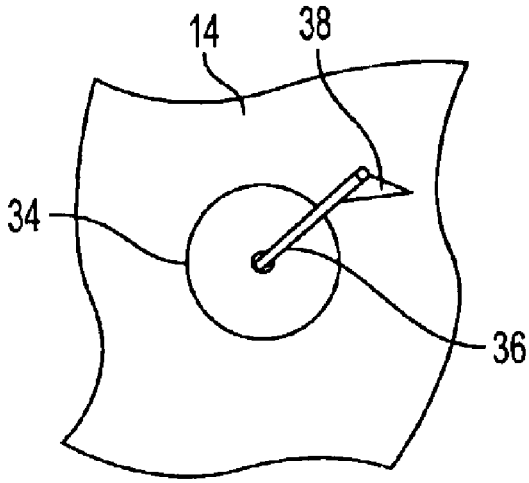
FIG. 2 is a top plan view of a target hole for the outdoor bulls-eye target golf course.

The target area 18 comprises an inner target zone 28 circumscribed by the first target line 22, an intermediate target zone 30 between the second target line 24 and the first target line 22, and an outer target zone 32 between the third target line 26 and the second target line 24. A target hole 34 is located at the center of the inner target area 28 for holding a standard golf ball. The target hole 34 has an opening along surface 14 and a floor disposed below surface 14. The target hole 34 may be defined by a cylindrical cup inserted into the ground. A preferred diameter for the target hole 34 is about six inches. As shown in FIG. 2, an elongate pole 36 has a lower end permanently secured at the center of target hole 34 and extends from the floor to an upper end carrying a flag 38. The height of pole 36 is selected so that the flag 38 is visible to players from a plurality of tee stations as explained further below. It should be appreciated that the term "center" as used herein is not required to be the exact center since some margin of error is allowable.

The golf course 10 comprises a plurality of tee stations 40 along surface 14 within periphery 16, and each tee station is located along an imaginary radial line from target hole 34. Twelve tee stations 40*a*–40*l* are provided for golf course 10 although the number of tee stations may vary. The tee stations may be elevated relative to the surrounding surface 14 and may have various peripheral configurations and sizes along surface 14. As shown for tee station 40*a*, it is preferred that each tee station be large enough to accommodate three tee sites 42 for being hit from by three players at one time. The tee sites 42 may be located in the middle of the tee stations, respectively. The tee sites 42 for each tee station are located a predetermined radial distance D from the target hole 34 ranging from about 25 yards to about 180 yards. In one embodiment, the distance D between the tee sites for the first tee station 40*a* and the target hole 34 is about 25 yards; the distance D between the tee sites for the second tee station 40*b* and the target hole is about 25 yards; the distance D between the tee sites for the third tee station 40*c* and the target hole is about 60 yards; the distance D between the tee sites for the fourth tee station 40*d* and the target hole is about 60 yards; the distance D between the tee sites for the fifth tee station 40*e* and the target hole is about 100 yards; the distance D between the tee sites for the sixth tee station 40*f* and the target hole is about 120 yards; the distance D between the tee sites for the seventh tee station and the target hole is about 120 yards; the distance D between the tee sites for the eighth tee station 40*h* and the target hole is about 130 yards; the distance D between the tee sites for the ninth tee station 40*i* and the target hole is about 140 yards; the distance D between the tee sites for the tenth tee station 40*j* and the target hole is about 110 yards; the distance D between the tee sites for the eleventh tee station 40*k* and the target hole is about 160 yards; and the distance D between the tee sites for the twelfth tee station and the target hole is about 180 yards.

Some of the tee stations are grass along surface 14, some are sand along surface 14, and some are dirt along surface 14. In the illustrated embodiment, tee stations 40*a*, 40*c*, 40*e*, 40*f*, 40*i*, 40*j*, 40*k* and 40*l* are grass; tee stations 40*b*, 40*d* and 40*h* are sand; and tee station 40*g* is dirt. Preferably, some of the grass tee stations are close-cut manicured grass and some are tall grass. In one embodiment, tee stations 40*a*, 40*c*, 40*e*, 40*i*, 40*j*, 40*k* and 40*l* are close-cut manicured grass and tee station 40*f* is tall grass. It is preferred that the grass target area and the grassy area surrounding the target area be close-cut and manicured to provide conditions similar to those found on a traditional golf course for the bounce and roll of golf balls landing on surface 14 after being hit to the target hole from the tee stations.

The tee stations may be uniformly or non-uniformly arranged about the target hole 34 at equal or unequally spaced radial locations about the target hole. A plurality of tee stations can be aligned with one another in the radial direction but at different predetermined distances D from the target hole. Such an arrangement may conserve space and is represented by tee stations 40*b* and 40*c*, by tee stations 40*e* and 40*f*, and by tee stations 40*h* and 40*i*. In addition to being aligned with one another in the radial direction, tee stations 40*h* and 40*i* are located adjacent one another in the radial direction for further conservation of space. Moreover, tee stations may be disposed adjacent one another in a circumferential direction about target hole 34 as represented by circumferentially adjacent tee stations 40*f* and 40*g*, which also conserves available space. Each tee station may be identified by a sign or other marker mounted at the tee station indicating the number of the tee station in accordance with the order in which the tee stations are to be played in the outdoor bulls-eye target golf game.

The golf course 10 includes at least one obstacle or hazard between the target hole 34 and one of the tee stations. By way of illustration, golf course 10 has two obstacles or hazards 44 and 44' located between the target hole 34 and tee stations 40*b* and 40*j*, respectively. The obstacle 44 between target hole 34 and tee station 40*b* comprises a plurality of trees 46 extending transversely across the radial line between target hole 34 and tee station 40*b*. The height of trees 46, the separation distance between trees 46, the clearance between trees 46 and the surface 14, and the distance from the tee sites for tee station 40*b* to the obstacle 44 are selected such that the obstacle 44 presents a physical barrier for players to hit golf balls over from the tee sites of tee station 40*b* to target hole 34. As an example, the trees 46 forming obstacle 44 may be about twenty feet tall and may be located about midway between the target hole 44 and the tee sites for tee station 40*b*. The obstacle or hazard 44' between target hole 34 and tee station 40*j* comprises a plurality of trees 46' extending transversely to the imaginary radial line between target hole 34 and tee station 40*j*. The height of trees 46', the separation distance between trees 46', the clearance between trees 46' and surface 14, and the distance from the tee sites for tee station 40*j* to obstacle 44' present a physical barrier for players to hit golf balls under from the tee sites of tee station 40*j* to target hole 34. The obstacles 44 and 44' are preferably naturally occurring formations or features to reduce maintenance and cost, and naturally occurring features pre-existing on parcel of land 12 may be used as obstacles. It is preferred that the obstacles used in golf course 10 be non-aquatic and that the obstacles present minimal risk for loss of golf balls, contrary to the high risk presented by conventional water obstacles. It should also be appreciated that the natural topography of parcel of land 12 can be used to provide various upward and downward slopes and other formations or features for greater difficulty and challenge.

Any number of alternative tee stations can be provided in golf course 10 for players of less ability or skill. As an example, alternative tee station 40*k'* shown in dotted lines in FIG. 1 is provided having tee sites 42' at a predetermined distance D of about 110 yards from target hole 34 as an alternative to tee station 40*k* for players for whom the greater predetermined distance D for tee station 40*k* is too long given the player's skill and ability. The alternative tee station 40*k*' is aligned with the tee station 40*k* in the radial direction to maintain similar conditions for players playing from either tee station 40*k* or 40*k*'. Accordingly, players of varying levels of skill and ability may be appropriately challenged for their particular level of skill and ability. Players of all ages, physical ability and skill may thusly be individually challenged under similar conditions while maintaining integrity and fairness in the outdoor bulls-eye golf game.

Figure 3:
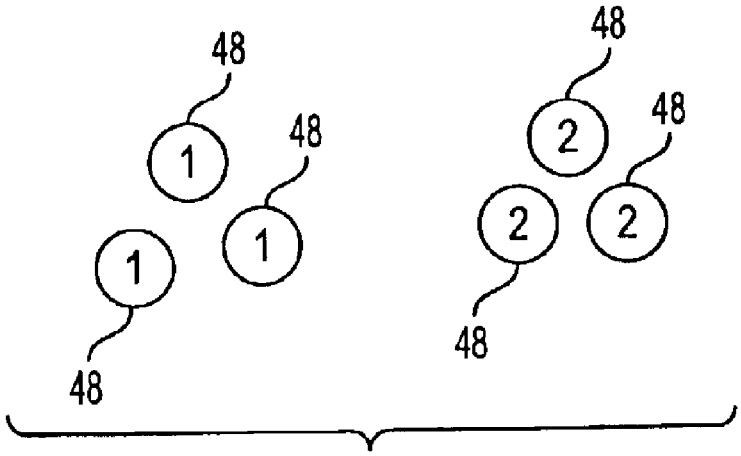
FIG. 3 depicts two sets of golf balls for use by different players of an outdoor bulls-eye target golf game according to the present invention with each set containing a plurality of conspicuously marked golf balls.

The outdoor bulls-eye target golf game according to the present invention is played on golf course 10 using standard golf balls and clubs as employed in traditional golf. The game may be played by a group of as many as twelve players at one time but could also be played individually by a single player. Each player is provided with a plurality of at least three golf balls, with each player's balls being conspicuously marked to distinguish them from the balls of the other players. Extra golf balls may be carried for use as replacements in the uncommon event of a lost ball. Markings may include colors and/or symbols including letters, numbers and/or pictures. FIG. 3 depicts as an example a first plurality of three golf balls 48 each marked with the number "1" for use by a first player and a second plurality of three golf balls 48 each marked with the number "2" for use by a second player.

The players approach the first tee station 40*a*, and each player hits his/her three golf balls from a tee site 42 of the tee station 40*a* to the target hole. Each player may select the appropriate golf club for the shot to be taken in accordance with the predetermined distance D to the target hole 34 from the tee station 40*a*. Since the tee station includes three tee sites, three players may hit to the target hole from the tee station at the same time, thereby increasing the pace of the outdoor bulls-eye target golf game, reducing the time required to complete the golf game and minimizing the waiting time for other players. It is actually preferred that shots are taken amid the normal activity and noise generated by other players and not under carefully controlled quiet conditions so that players will learn to concentrate and focus in spite of distractions. The flag 38 makes the target hole 34 clearly identifiable from the tee station 40*a* so that the players know the exact spot to hit to.

Once the players have hit their three golf balls to the target hole 34, the players walk toward where their balls have landed and ascertain the landing spots for their balls. The landing spots will be those locations at which the balls come to rest after any bounce, roll and/or other movement of the balls upon hitting surface 14. Since the target area 18 and the area of surface 14 surrounding target area 18 are grass, the bounce, roll and/or other movement of the balls will replicate that of a traditional golf course. Each player eliminates his/her worst played ball from scoring, the worst played ball being the ball landing furthest from the target hole 34. Each player scores his/her remaining two balls by assigning one point to balls landing in the target hole 34, two points to balls landing in the inner target zone 28, three points to balls landing in the intermediate target zone 30, four points to balls landing in the outer target zone 32, and five points to balls landing outside the target area 18. The scoring system is structured so that weaker skilled players do not fall hopelessly behind and lose their confidence and motivation. The scoring system associates greater accuracy with fewer points consistent with the scoring concepts of traditional golf.

Similar to traditional golf, each player records his/her own score on a score card for that player. FIG. 4 depicts a sample scorecard 50 for the outdoor bulls-eye target golf game indicating the numerical order for the first through twelfth tee stations 40*a*–40*l*, the corresponding distances D for the tee stations 40*a*–40*l* and boxes or spaces for the entry of points. For each of the first through twelfth tee stations 40*a*–40*l*, scorecard 50 has two boxes or spaces for the player to enter the points incurred for that player's two balls "Ball 1" and "Ball 2" remaining after elimination of the player's worst played ball. Accordingly, the points incurred for one of the two remaining balls is entered in the box for "Ball 1" and the points for the other remaining ball is entered into the box for "Ball 2". For each tee station, the points for "Ball 1" and "Ball 2" may be totaled and entered into the box identified by "Ball1+Ball 2". The scoring system provides quantifiable feedback to the player regarding the player's accuracy from the particular predetermined distance D for the tee station 40*a*. In addition, quantifiable information is provided regarding the player's improvement since a plurality of balls are hit from the tee station 40*a*. It should be appreciated that the score card 50 could include boxes or spaces for recording the points incurred by the eliminated ball to provide a more comprehensive measure of the player's skill and improvement. If a player's ball hits another ball when landing on the surface 14, all balls are scored from their final landing spots after all players have hit. After the players have hit, scored and collected their golf balls, the players move on to the next tee station 40*b*.

The aforementioned steps are repeated at each tee station until all of the tee stations have been played by all players. Typically, the players will walk from the tee stations toward the target area to score and collect their balls and then on to the next tee station, and this walking provides physical conditioning beneficial for traditional golf. Various skills utilized in traditional golf, except for putting, are executed by the players as they proceed through the golf course 10. In the illustrated golf course, for example, the players chip from grass at the first tee station 40*a* and thereby execute chipping skills; the players play from a sand trap at the second tee station 40*b* and thereby execute sand trap skills; the players pitch over about a 20 foot barrier at the third tee station 40*c* and thereby execute lofting skills; the players play from a sand trap at the fourth tee station 40*d*, further away from the target hole than the sand trap at tee station 40*b*, and thereby further execute sand trap skills; the players play from grass at the fifth tee station 40*e* and thereby execute distance skills; the players play from tall grass at the sixth tee station 40*f* a further distance from the target hole than tee station 40*e* and thereby execute distance and grass skills; the players play from dirt at the seventh tee station 40*g* and thereby execute dirt skills; the players play from a sand trap at the eighth tee station 40*h*, at a further distance from the target hole than tee station 40*d*, and thereby further execute sand trap skills; the players play from grass at the ninth tee station 40*i* at a further distance from the target hole than tee stations 40*e* and 40*f* and thereby further execute distance skills; the players play from grass while hitting under a barrier at the tenth tee station 40*j* and thereby execute skills associated with hitting under a barrier or trees; the players play from grass at the eleventh tee station 40*k* a further distance from the target hole than tee station 40*i* and thereby further execute distance skills; and the players play from grass at the twelfth tee station 40*l* a further distance from the target hole than tee station 40*k* and thereby further execute distance skills.

After all tee stations 40*a*–40*l* have been played by all players, the players calculate their total points, for example by summing all of the numbers in the column corresponding to "Ball 1+Ball 2" and entering this sum in the box identified on the score card as "Total Points". The player having the lowest score, i.e. total points, is declared the winner of the bulls-eye target golf game. The desire to perform better than the other players provides competitive motivation and entertainment. However, competitive motivation is provided even when the outdoor bulls-eye target golf game is played by one player since the player will be motivated to improve upon his/her previous scores. Since each tee station provides predetermined distances and conditions, the player's performance in the outdoor target bulls-eye golf game can be used to identify weaknesses in the player's skills which may be improved upon by further practice. Players may retain their score cards to obtain a cumulative or comprehensive picture of their level of skill and improvement and to better identify weak areas over time.

The outdoor bulls-eye target golf course of the present invention is well adapted for installation in many various locations using the natural topography of the land. The outdoor bulls-eye target golf course can be economically installed and maintained, and can be maintained with minimal intervention. The outdoor bulls-eye target golf course avoids the difficulties associated with complex physical structure and does not require any particular set up prior to playing a game thereon. The tee stations are large enough to accommodate more than one player hitting from a tee station at the same time. The golf course can be designed with various predetermined distances, hazards and conditions for the practice of a wide range of traditional golf skills including chipping, pitching, lofting, sand trap, dirt, distance, hazard, fade, draw and/or slope skills. The target lines do not require any physical structure to impede or interfere with golf balls landing in the target area. The golf course may be dedicated for exclusive use by a group of players until they have completed a bulls-eye target golf game on the golf course. Any of the tee stations may have alternate tee stations for players of less skill and ability such that an individual golf course can accommodate players of varying levels of skill and ability.

The bulls-eye target golf game of the present invention presents a challenging, motivational, entertaining and informational past-time while also providing preparation and practice for traditional golf. The bulls-eye target golf game provides a challenge for players of all ages and levels of skill and ability. The bulls-eye target golf game played on the outdoor bulls-eye target golf course accommodates groups of as many as twelve players at one time while still allowing the golf game to be completed within a reasonable amount of time. By providing for a plurality of balls to be hit from each tee station and for the elimination of the worst played ball, skill improvement is facilitated while not unduly penalizing a player for randomly anomalous shots. Practice and skill execution are reinforced through repetition. The scoring system is consistent with the general concepts of traditional golf without being discouraging to less-skilled players. The bulls-eye target golf game allows players to identify and assess specific weaknesses as well as level of improvement. When played regularly, the bulls-eye target golf game can provide a comprehensive or cumulative picture of a player's skills, weaknesses and improvements. By providing an opportunity for walking, the bulls-eye target golf game provides physical conditioning benefits applicable to traditional golf.

Inasmuch as the present invention is subject to various modifications, additions or changes in detail, the preferred embodiments described herein should be considered illustrative only and should not be taken in a limiting sense since various modifications can be made thereto without departing from the scope of the invention as defined by the appended claims.

What is claimed is:

1. A method of playing an outdoor bulls-eye target golf game comprising the steps of each player hitting a like plurality of standard golf balls for that player from a tee site of a tee station to a single target hole located in the ground a predetermined distance from the tee station in a grassy target area comprising a plurality of concentric target lines including a first circular target line of first diameter circumscribing an inner target zone, a second circular target line of second diameter, greater than the first diameter, circumscribing an intermediate target zone between the second target line and the first target line, and a third circular target line of third diameter, greater than the second diameter, circumscribing an outer target zone between the third target line and the second target line, and the target hole at the center of the inner target zone, said step of hitting comprising each player hitting each golf ball for that player with only one swing;

each player eliminating one of the golf balls hit by that player which has landed furthest away from the target hole;

each player scoring a remaining plurality of the golf balls hit by that player which have landed closer to the target hole than the eliminated golf ball, said step of scoring comprising the steps of assigning one point for golf balls landing in the target hole, two points for golf balls landing in the inner target zone, three points for golf balls landing in the intermediate target zone, four points for golf balls landing in the outer target zone and five points for golf balls landing outside the target area;

each player repeating said step of hitting to the single target hole, said step of eliminating and said step of scoring for a plurality of the tee stations located different predetermined distances from the single target hole; and each player totaling the points for that player upon completion of said step of repeating, whereby the player with the lowest point total is declared the winner of the golf game.

2. The method of playing an outdoor bulls-eye target golf game recited in claim 1 wherein said step of hitting includes more than one player hitting from respective tee sites of the tee station to the target hole at the same time.

3. The method of playing an outdoor bulls-eye target golf game recited in claim 1 wherein said step of hitting includes each player selecting an appropriate golf club for hitting the golf balls for that player in accordance with the predetermined distance for the target hole from the tee station.

4. The method of playing an outdoor bulls-eye target golf game recited in claim 1 wherein said step of hitting includes each player hitting three golf balls for that player from the tee station to the target hole and said step of scoring includes scoring two of the three golf balls for that player.

5. The method of playing an outdoor bulls-eye target golf game recited in claim 1 wherein said step of hitting includes each player hitting a plurality of standard golf balls having visual uniqueness distinguishing the golf balls of that player from the golf balls of other players.

6. The method of playing an outdoor bulls-eye target golf game recited in claim 1 wherein said step of hitting includes each player hitting the plurality of golf balls for that player from a first tee station located about 25 yards from the target hole, and said step of repeating said step of hitting includes each player hitting the plurality of golf balls for that player from a second tee station located about 25 yards from the target hole, from a third tee station located about 60 yards from the target hole, from a fourth tee station located about 60 yards from the target hole, from a fifth tee station located about 100 yards from the target hole, from a sixth tee station located about 120 yards from the target hole, from a seventh tee station located about 120 yards from the target hole, from an eighth tee station located about 130 yards from the target hole, from a ninth tee station located about 140 yards from the target hole, from a tenth tee station located about 110 yards from the target hole, from an eleventh tee station located about 160 yards from the target hole and from a twelfth tee station located about 180 yards from the target hole.

7. The method of playing an outdoor bulls-eye target golf game recited in claim 6 wherein said step of hitting includes each player hitting the plurality of golf balls for that player from grass at the first tee station, and said step of repeating said step of hitting includes each player hitting the plurality of golf balls for that player from sand at the second tee station, from grass at the third tee station, from sand at the fourth tee station, from grass at the fifth tee station, from taller grass at the sixth tee station, from dirt at the seventh tee station, from sand at the eighth tee station, and from grass at the ninth, eleventh and twelfth tee stations.

8. The method of playing an outdoor bulls-eye target golf game recited in claim 6 wherein at least one of said step of hitting and said step of repeating said step of hitting includes each player hitting the plurality of golf balls for that player from one of the tee stations over a barrier located between the one tee station and the target hole.

9. The method of playing an outdoor bulls-eye target golf game recited in claim 6 wherein at least one of said step of hitting and said step of repeating said step of hitting includes each player hitting the plurality of golf balls for that player from one of the tee stations under a barrier located between the one tee station and the target hole.

10. The method of playing an outdoor bulls-eye target golf game recited in claim 1, wherein said step of scoring includes each player recording the score for that player on a score card for that player.

11. The method of playing an outdoor bulls-eye target golf game recited in claim 1 and further including, subsequent to each player hitting the plurality of golf balls from a tee station, the steps of each player walking from the tee station to the landed golf balls for that player, each player collecting the landed golf balls for that player, and each player walking to the next tee station to be hit from.

12. The method of playing an outdoor bulls-eye target golf game recited in claim 1 wherein said steps of hitting include each player hitting from at least some tee stations that are located in alignment along the same imaginary line radial to the target hole.

13. The method of playing an outdoor bulls-eye target golf game recited in claim 1 wherein said steps of hitting include each player hitting from at least some tee stations that are located along different imaginary lines radial to the target hole.

14. The method of playing an outdoor bulls-eye target golf game recited in claim 1 wherein said steps of hitting include each player hitting to the single target hole located in a target area having non-structural target lines.

15. The method of playing an outdoor bulls-eye target golf game recited in claim 14 wherein said steps of hitting include each player hitting to the single target hole located in a target area having target lines defined by a colored substance applied to the grass of the target area.

16. The method of playing an outdoor bulls-eye target golf game recited in claim 1 wherein said method is performed on an outdoor bulls-eye target golf course containing the single target hole, the target area, and the plurality of the tee stations arranged around the single target hole.

17. The method of playing an outdoor bulls-eye target golf game recited in claim 1 wherein said steps of hitting include each player hitting to the single target hole located in a target area including a first circular target line of 20 feet in diameter, a second circular target line of 70 feet in diameter, and a third circular target line of 120 feet in diameter.

18. The method of playing an outdoor bulls-eye target golf game recited in claim 8 wherein said step of hitting over a barrier includes hitting over a non-aquatic natural barrier.

19. The method of playing an outdoor bulls-eye target golf game recited in claim 18 wherein said step of hitting over a barrier includes hitting over a tree.

20. The method of playing an outdoor bulls-eye target golf game recited in claim 9 wherein said step of hitting under a barrier includes hitting under a tree.

* * * * *